United States Patent [19]

Anderson et al.

[11] 3,953,852

[45] Apr. 27, 1976

[54] WIDE BANDWIDTH PHASE SCANNING WITH SIMPLE CONTROLS

[75] Inventors: Wallace E. Anderson, Beltsville; Albert D. Krall, Rockville; Albert M. Syeles; Oscar J. Van Sant, both of Silver Spring, all of Md.

[73] Assignee: The United States of America as represented by the Secretary of the Navy, Washington, D.C.

[22] Filed: July 13, 1973

[21] Appl. No.: 379,859

[52] U.S. Cl. ..... 343/100 SA; 328/160; 331/45; 331/48; 343/854

[51] Int. Cl.[2] ..... H01Q 3/26

[58] Field of Search ..... 343/100 SA, 854; 331/45, 48; 328/160

[56] References Cited

UNITED STATES PATENTS 3,307,188 2/1967 Marchetti et al. ..... 343/100 SA

*Primary Examiner*—Maynard R. Wilbur
*Assistant Examiner*—Richard E. Berger
*Attorney, Agent, or Firm*—R. S. Sciascia; J. A. Cooke; W. W. Cochran

[57] ABSTRACT

A modified Huggin's Scanner whose tunable signal bandwidth can be broadened without affecting the beam position and whose output beam direction is dependent on the control of a resistor. Two separate voltage controlled oscillators are utilized in this system in addition to modifying the input frequency controls to the scanner.

2 Claims, 3 Drawing Figures

WIDE BANDWIDTH PHASE SCANNING WITH SIMPLE CONTROLS

BACKGROUND OF THE INVENTION

The present invention relates generally to directive type communication systems and more specifically to phased array electronically steered antennas.

The common method of arranging a phased array antenna is to distribute microwave energy along a delay line in an IF scanner that has equally spaced outputs such that the phase of the outputs is known and fixed at each terminal. The difference in output phase $\Delta\phi$ between each adjacent output terminal is a function of the output frequency, $f_o$, and the angle the beam makes off broadside, $\theta_o$, (i.e., the direction of the propagated beam from a perpendicular to the antenna array). The relationship is given by: $\Delta\phi = 2\pi s/c\, f_o \sin\theta_o$ where $s$ is the spacing between antenna elements in the array and $c$ is the speed of light. More simply we can write:

$$\Delta\phi = k_3 f_o \sin\theta_o$$

Thus the output beam propagation direction $\theta_o$ is a function of the output frequency $f_o$ and the difference in output phase $\Delta\phi$, which is linearly related to changes in output frequency for fixed delay line IF scanners.

To independently control the antenna propagation direction $\theta_o$, prior systems have utilized phase shifters at each element of the array which are capable of introducing a progressive phase shift across the antenna array. These phase shifters can thus be controlled independently of the output frequency. However, the phase shift required for any desired beam direction is still dependent on the output frequency. Thus to change either output frequency or beam direction or both, the phase shift must be recalculated in each instance. This requires the use of expensive computing mechanisms especially where a rapid change in frequency and in some instances direction is required, e.g., radar tracking where the tracking frequency is rapidly changed to avoid detection and the use of countermeasures by the target.

SUMMARY OF THE INVENTION

The present device modifies one of the inputs to an IF scanner so that the beam direction $\theta_o$ can be controlled independently of changes in the output frequency. In standard IF scanners, the output frequency is a function of the frequency of a first input signal and the phase difference between each adjacent output is a function of the frequency of a second input signal. It can be shown from the equation:

$$\Delta\phi = k_3 f_o \sin\theta_o$$

that the beam direction of the phased array antenna, $\theta_o$, is a function of both the first input signal and the second input signal to the IF scanner. By modifying the second input signal to contain a portion of the first input signal, the beam direction of the antenna $\theta_o$ becomes solely a function of the second input signal. Since the output frequency is only a function of the first input signal, the output frequency can be readily changed without affecting the beam direction of the antenna.

It is therefore the object of the present invention to provide a simple, inexpensive IF scanner for independently controlling beam direction and output frequency in a phased array antenna.

Another object of the invention is to provide an electronically steered phased array antenna which will allow changes in output beam direction, output frequency or both automatically.

An additional object of the invention is to provide an inexpensive, simply electronically steered phased array antenna which is capable of changing either beam direction or output frequency in a rapid manner.

Other objects, advantages and novel features of the invention will become apparent from the following detailed description of the invention when considered in conjunction with the accompanying drawing wherein:

DETAILED DESCRIPTION OF THE PREFERRED EMBODIMENT

Figure 3:
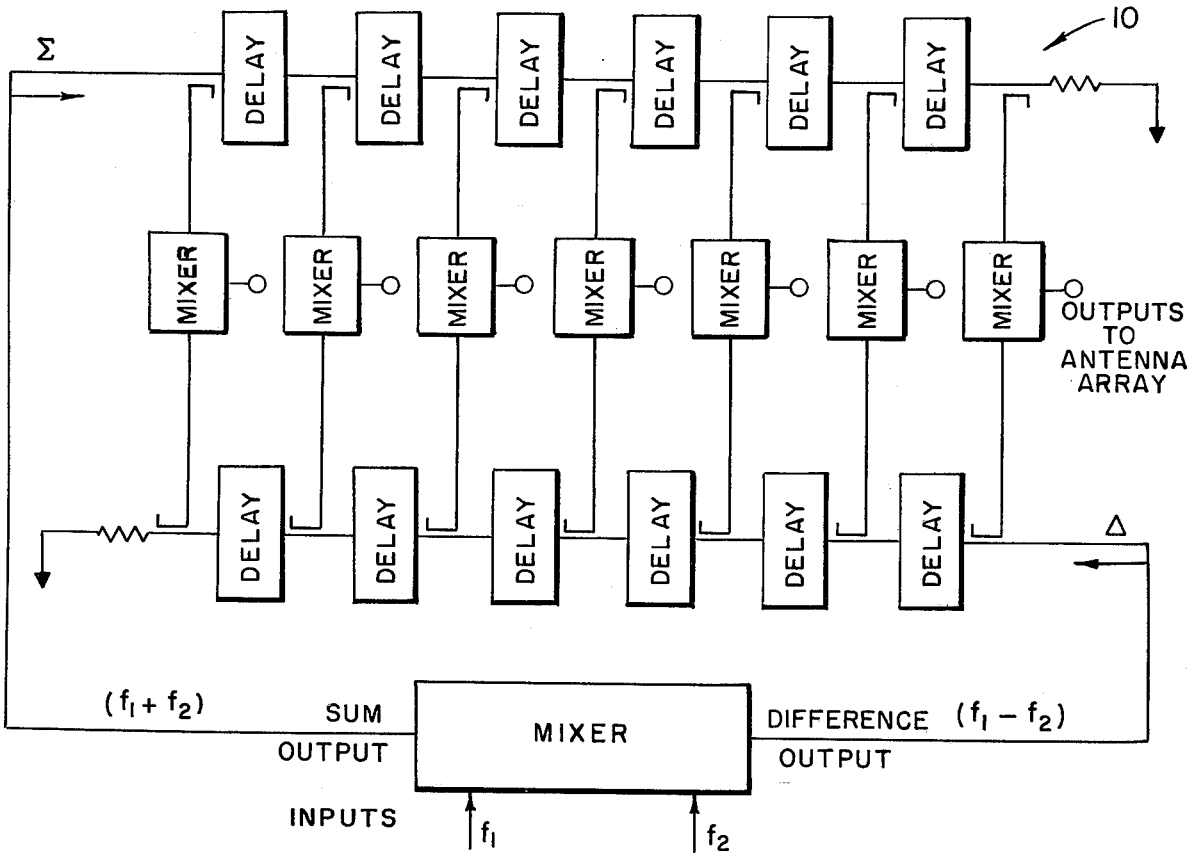
FIG. 3. PRIOR ART
FIG. 3 is a detailed block diagram of a phased array antenna scanning system.
Figure 1:
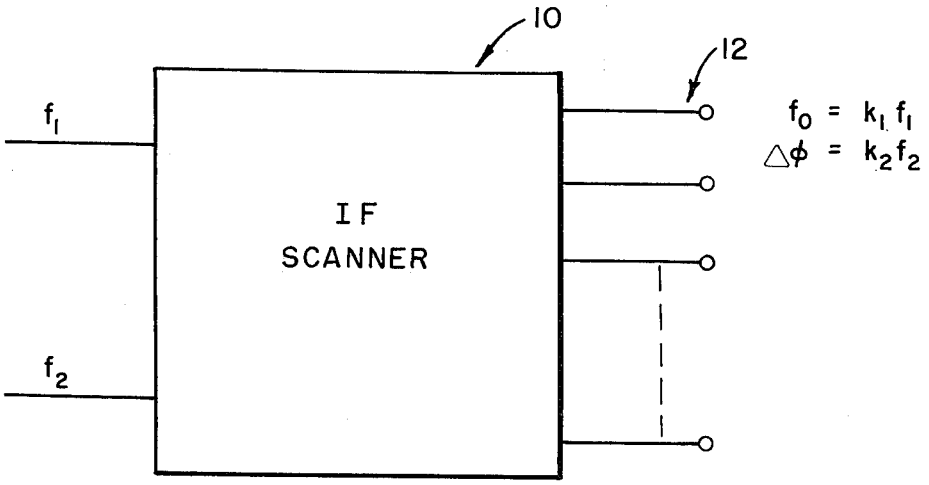
FIG. 1. PRIOR ART
FIG. 1 shows a block diagram conventional phased array antenna scanning system.

The IF scanner 10 of FIG. 1 and FIG. 3 is a system of delay lines and frequency mixers configured in such a way that the output frequency $f_o$ and relative phase $\phi$ of an array of output terminals is an independent function of two independent input frequencies $f_1$ and $f_2$. This is shown schematically in FIG. 1, where $f_o$ is the output frequency, $f_1$ and $f_2$ are the frequencies associated with the input signal generators and $\Delta\phi$ is the relative phase difference between any two adjacent output terminals. When the output terminals 12 are applied to antennas to form a phased array scanning system, a change in output frequency produces a change in beam direction since $\Delta\phi = k_1 f_o \sin\theta_o$.

Figure 2:
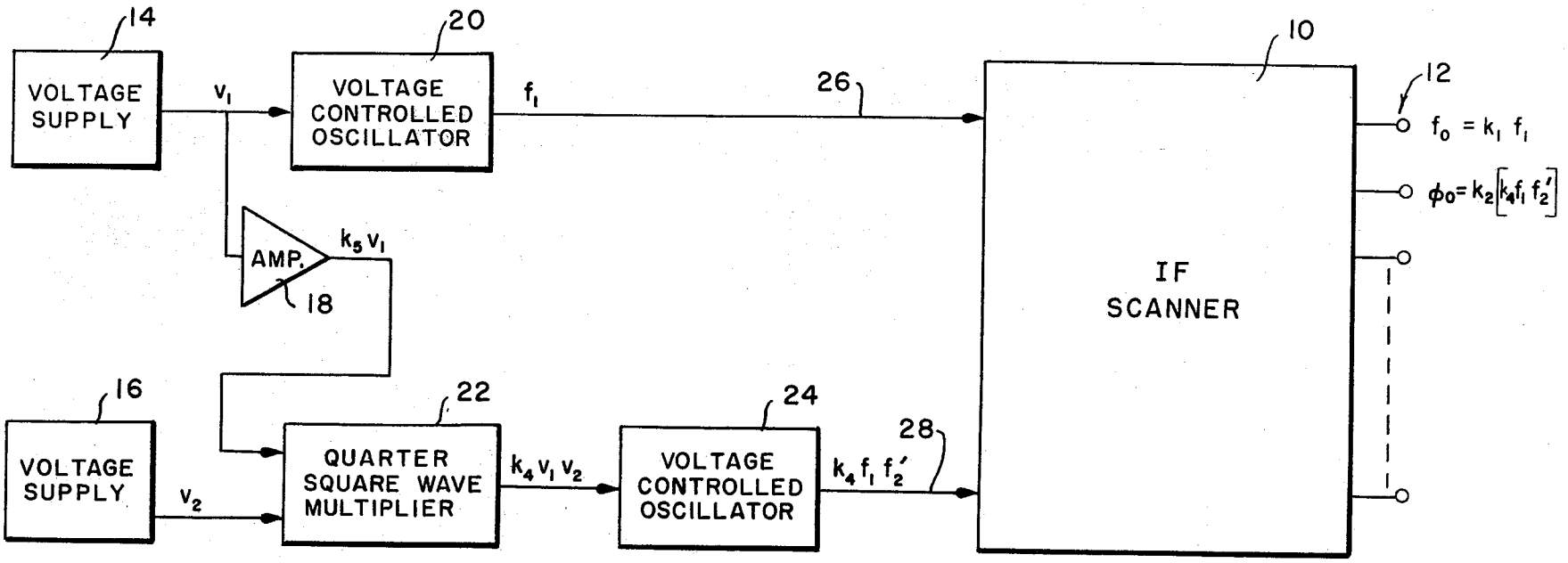
FIG. 2 is a block diagram of the preferred embodiment.

By modifying the input frequency controls, the output phase difference can be changed as is shown in FIG. 2. When the output terminals of the configuration in FIG. 2 are applied to antennas to form a phase scanning array, a change in output frequency will not change the beam direction. The extra factor in the output phase difference is the quantity needed to make the beam pointing direction $\theta_o$ a function of only the input frequency $f_2$. The output frequency remains a function of only the input frequency $f_1$.

this can be shown mathematically by the following equations:

Given for a conventional IF scanner:

$$f_o = k_1 f_1$$

$$\Delta\phi = K_2 f_2$$

$$\Delta\phi = k_3 f_o \sin\theta_o$$

then $$\Delta\phi = k_3(k_1 f_1)\sin\theta_o = k_2 f_2$$

thus $$\theta_o = \sin^{-1}\left[\frac{(K_2)}{k_1 k_3}\ \frac{f_1}{f_2}\right]$$

therefore $\theta_o$ is function of both $f_1$ and $f_2$. But by using the present device if:

$$f_2 = k_4 f_1 f_2'$$

then given $$\Delta\phi = k_3 (k_1 f_1) \sin \theta_o = k_2 (k_4 f_1 f_2')$$

we have $$\theta_o = \sin^{-1} \left[ \frac{k_2 k_4}{k_1 k_3} \cdot f_2' \right]$$

thereby making $\theta$ a function of $f_2'$ alone.

Physically this means that the output frequency can be changed solely by changing the frequency of the input signal at input 26 of FIG. 2 while the beam direction can be changed solely by changing $f_2'$.

FIG. 2 is a block diagram of apparatus for generating the necessary functions. Voltages supply 14 generates a voltage V, which is applied to a voltage controlled oscillator 20 which in turn produces a signal which is applied to input 26 of IF scanner 10 having a frequency $f_1$ linearly related to the magnitude of $V_1$. $V_1$ is also applied to an amplifier 18 which produces a signal $k_3V_1$ which is in turn applied to a quarter square wave multiplier 22 along with a second voltage $V_2$ produced by a second voltage supply 16. Quarter square wave multiplier 22 produces a signal $k_4V_1V_2$ which is applied to another voltage controlled oscillator 24 which produces an output signal having a frequency $k_4f_1f_2'$ which is applied to input 28 of IF scanner 10. Thus the functions necessary to be applied to the input of the IF scanner 10 have been generated using two voltage controlled oscillators. The independent controls of voltage supplies 14 and 16 respectively control the output frequency and the beam direction.

The advantage of this device is that it uses two simple, unique controls for determining the output beam position and frequency, such that corrections for movement of the antenna, e.g., with the roll of a ship or vibration in the antenna platform, can be made in a simple manner resulting in a beam fixed in space.

Obviously, many modifications and variations of the present invention are possible in light of the above teachings. For example, the entire input modification could be controlled digitally and even some of the preliminary functions of the IF scanner could be incorporated in digital frequency synthesizer. It is therefore to be understood that within the scope of the appended claims the invention may be practiced otherwise than as specifically described.

We claim:

1. A device for generating signals for an IF scanner used to electronically steer a phased array antenna comprising:

first signal generating means for generating a signal having a first parameter;

second signal generating means for generating a second signal having a second parameter;

multiplier means connected to said first and said second signal generating means for producing a signal having a third parameter which is some multiple of said first and said second parameters;

first control means connected to said first signal generating means for generating a first signal having a frequency proportional to said first parameter;

second control means connected to said multiplier means for generating a signal having a frequency proportional to said third parameter.

2. The device of claim 1 wherein said first, second and third parameters are voltage.

* * * * *